US005249667A

United States Patent [19]

Hill et al.

[11] Patent Number: 5,249,667

[45] Date of Patent: Oct. 5, 1993

[54] APPARATUS FOR MAINTAINING OPTIMUM ARTIST'S PIGMENT MEDIA CHARACTERISTICS AND METHOD OF MAKING SAME

[75] Inventors: David C. Hill, Attleboro; Richard A. Hildebrandt, Chappaquiddick Island, both of Mass.

[73] Assignee: MLC Technologies, Inc., Attleboro, Mass.

[21] Appl. No.: 593,113

[22] Filed: Oct. 5, 1990

[51] Int. Cl.[5] ..... B05C 17/00

[52] U.S. Cl. ..... 206/1.8; 206/1.7; 428/34.4; 428/325

[58] Field of Search ..... 206/1.8, 1.9, 1.7; 428/34.4, 34.5, 312.2, 312.6, 323, 325, 688

[56] References Cited

U.S. PATENT DOCUMENTS

| | | | |
|---|---|---|---|
| 294,591 | 3/1860 | Crandall . | |
| 446,953 | 2/1891 | Robert . | |
| 918,563 | 4/1909 | Lewis . | |
| 924,865 | 6/1909 | Wilson . | |
| 1,130,203 | 3/1915 | Schreyer . | |
| 1,212,188 | 1/1917 | Couper . | |
| 1,414,338 | 5/1922 | Bruck . | |
| 1,699,388 | 1/1929 | Beindorff . | |
| 1,835,884 | 12/1931 | Lindsey . | |
| 1,891,110 | 12/1932 | Petranovich . | |
| 1,901,861 | 3/1933 | Baker . | |
| 2,071,169 | 2/1937 | Killik . | |
| 2,533,618 | 12/1950 | Pinanski . | |
| 2,680,871 | 6/1954 | Gullholm . | |
| 2,711,605 | 6/1955 | Dripps . | |
| 2,728,157 | 12/1955 | Guthrie . | |
| 2,914,876 | 12/1959 | Osler . | |
| 2,923,081 | 2/1960 | Simmons . | |
| 3,023,884 | 3/1962 | Schwartz . | |
| 3,089,584 | 5/1963 | King . | |
| 3,185,113 | 5/1965 | Nathan et al. . | |
| 3,273,700 | 9/1966 | Moreau et al. . | |
| 3,280,966 | 10/1966 | Boniface . | |
| 3,352,616 | 11/1967 | Linger . | |
| 3,428,167 | 2/1969 | Sheng . | |
| 3,434,588 | 3/1969 | Kirkpatrick | 206/1.9 |
| 3,446,337 | 5/1969 | Blackmon . | |
| 3,576,252 | 4/1971 | Conolly . | |
| 3,650,589 | 3/1972 | Linger . | |
| 3,672,742 | 6/1972 | Barg . | |
| 3,732,972 | 5/1973 | Israel . | |
| 3,779,369 | 12/1973 | Lang . | |
| 3,786,913 | 1/1974 | Crawford . | |
| 3,804,030 | 4/1974 | Israel . | |
| 3,874,499 | 4/1975 | Barnett, Jr. . | |
| 3,885,666 | 5/1975 | Maxwell . | |
| 3,885,843 | 5/1975 | Rubel . | |
| 3,924,733 | 12/1975 | DeLong . | |
| 3,945,490 | 3/1976 | Thompson . | |
| 4,046,250 | 9/1977 | Amezcua . | |
| 4,142,627 | 3/1979 | Szegi . | |
| 4,244,993 | 1/1981 | Platka, III et al. | 428/34.5 |
| 4,324,834 | 4/1982 | Page et al. | 428/312.6 |
| 4,372,630 | 2/1983 | Fuhri . | |
| 4,444,306 | 4/1984 | Benaquista . | |
| 4,737,390 | 4/1988 | Fricano et al. | 428/34.5 |
| 4,787,837 | 11/1988 | Bell | 264/284 |
| 4,852,725 | 8/1989 | Folsom . | |
| 4,901,850 | 2/1990 | McIntosh . | |
| 4,966,201 | 10/1990 | Svec et al. | 428/34.4 |
| 4,981,823 | 1/1991 | Crutchley et al. | 501/1 |
| 4,987,028 | 1/1991 | Kandachi et al. | 428/312.2 |

FOREIGN PATENT DOCUMENTS

| | | |
|---|---|---|
| 1025303 | 2/1958 | Fed. Rep. of Germany . |
| 1360379 | 3/1963 | France . |

*Primary Examiner*—David T. Fidei
*Attorney, Agent, or Firm*—John A. Haug

[57] ABSTRACT

An artist's palette is shown having surface roughness values conducive to wetting, spreading and suspension maintenance of water color, acrylic and other pigment media. Porous materials having selected permeability versus open porosity are disclosed which are useful both as in a palette substrate as well as a color pot in a reservoir system module that provides extended pigment suspension life. Interchangeable color pots receivable in modules which in turn are receivable in work boxes are disclosed providing optimum artist flexibility.

17 Claims, 5 Drawing Sheets

APPARATUS FOR MAINTAINING OPTIMUM ARTIST'S PIGMENT MEDIA CHARACTERISTICS AND METHOD OF MAKING SAME

BACKGROUND OF THE INVENTION

1. Field of the Invention The present invention relates generally to artists' implements for storing, mixing and using pigment media and more specifically such implements which provide and maintain optimum characteristics for such media of various types for extended periods of time relative to that available in the prior art.

2. Description of the Related Art

Over the years many materials, utensils and other articles have been utilized by artists to store, mix and deliver paint ingredients. Certain materials have been found to be more acceptable than others for particular types of paints. For example, certain materials are preferred with regard to palettes used for mixing paint materials and holding them for application to the surface chosen for the art object, i.e., paper, canvass or the like. For example, when using water color painting media, polymeric, metal, ceramic, porcelain enamel glass and coated materials are among the materials which have been used for palettes. The polymeric and metal palette materials, although easily fabricated and economical, are not wet by water color media suspensions and exhibit extensive puddling and beading behavior. Inorganic materials such as glass, ceramic and porcelain enamel, which exhibit good wetting and spreading characteristics, are generally preferred. In particular, porcelain enamel has been accepted by many professional artists as one of the most suitable palette substrate materials.

Typically, a water color artist places water and desired pigment colors containing suitable water-soluble binders, either in dry or wet form on the palette. The pigment-binder-water suspension is mixed using a brush or other utensil. Each artist has a preferred method for adding pigments and water to achieve the color, translucency and intensity desired. When the final pigment suspension mixture is achieved the suspension is applied to the painting surface (usually an adsorbent paper), typically with a water color brush. The applied pigment suspension will lose water because of paper adsorption and the pigment will be bonded to the paper surface when the resin binder is dried.

The artist using acrylic and egg tempera paints uses similar tools and will manage his pigment color suspensions in a manner similar to water color suspensions. The nature of these media, water-bearing liquid-emulsified binder-pigment suspensions, however is different compared to water color media, water-soluble binder resin-pigment suspensions, and are much more susceptible to drying environments compared to water colors. For example, exposed acrylic emulsions will lose fluid (water) and a skin can form quickly on the exposed surface due to emulsion breakdown. Unlike water color media, acrylic suspensions become unusable when this condition is reached. They cannot be reconstituted because the acrylic polymer chains are interwoven and permanently set. Knowing this, the acrylic artist has developed his painting technique and will limit his acrylic color pigments exposure generally for short periods, about 15–30 minutes. Egg tempera suspensions are even more prone to drying, emulsion breakdown and have shorter painting session life compared to acrylic and water color medias.

One of the vexations that have plagued artists is that the suspension characteristics change more quickly than is desired. This requires the continual attention of the artist including fluid addition, pigment replenishment to the working palette and the like making color matching and painting a tedious and more time consuming task.

One object of the invention is the provision of a palette which exhibits optimum wetting and spreading characteristics. Another object is the provision of such a palette on which fluid-suspension mixtures remain stable for extended periods of time relative to prior art palettes. Yet another object is the provision of a palette which is resistant to surface contamination and is easily cleaned. Another object of the invention is the provision of a palette which can be used with water-bearing pigment media, in particular, water-soluble types such as water color, gouache, ceramic glazes/underglazes, etc. and water-emulsion types such as acrylic, casein, egg tempera, etc.

The problem of changes in suspension characteristics also exists with paint or color pots, small containers which an artist uses to store a working supply of wet pigments prior to delivery to the palette. Conventionally, artists have used impervious materials such as wood, plastic, metal, ceramic, glass jars and other materials for pots to hold their pigment colors. However, the pigment suspension properties vary more quickly than is desired, particularly when exposed to certain environmental conditions such as might be encountered on field trips where exposure to direct sun light, wind and low humidity conditions can occur. Such exposure conditions have an immediate and direct impact on the fluid retention of the pigment suspensions. Depending upon specific environmental conditions encountered, water color pigment systems held in conventional pots will maintain suitable pigment suspension characteristics for about a half hour to three hours. Acrylic emulsion pigments are typically acceptable for ten to thirty minutes while egg tempera mixtures have only a ten to twenty minute life span.

It is an object of the invention to extend these periods of time to more useful periods. Another object of the invention is to provide palettes and paint pots which are adapted for use with water-based systems. Another object is to provide paint pots and working surfaces acceptable for organic solvent-based paint and ink medias. A further object of the invention is to provide working surfaces and pots which can be easily cleaned and reused. Yet another object is the provision of a work box system in which palettes and color pots as well as other artist tools such as paint brushes, water color pigment containers, storage containers and the like can be easily arranged in accordance with various painting activities and requirements.

Other objects and advantages of the invention will become apparent upon reading the following detailed description.

SUMMARY OF THE INVENTION

Briefly, in accordance with the invention, an artist's paint or color pot is provided which is suitable for various pigment media containment including water-soluble systems such as water color, gouache; emulsion systems such as acrylic, casein, egg tempera; ceramic color suspensions including under-glaze, glazes, over-glazes; and organic solvent medias including oil, alkyd and ink media. According to a feature of the invention such pots are formed of porous material which is wettable by a fluid and by the pigment suspension and having permeability versus relative open porosity within the pentagonal area defined by points A, B, C, D, and E of FIG. 12. The color pot is saturated with a fluid compatible with the pigment media and then placed in a reservoir of the fluid. The porous material will transport fluid from the reservoir to pigment media in the color pot though the color pot wall or membrane to make up for any fluid lost by the pigment through evaporation and the like thereby maintaining the pigment suspension in the pot at optimal working condition. According to another feature of the invention artist's palette surfaces are provided having desirable wetting, spreading and suspension retaining characteristics. Such surface characteristics may be achieved in the palette manufacture or by conditioning suitable materials, including porous materials, so that the surface has a selected uniform roughness characteristic $R_{(e)}$ value between approximately 5 and 50 microinch. According to yet another feature of the invention color pots are dimensioned so that their length and widths are whole integers of one another so that a container or pot module with air-tight cover, having a liquid reservoir therein dimensioned to accept whole integers of the color pots can receive various combinations of different sizes of such color pots so that different pigment quantities and colors can be selected for various tasks which will conveniently fit in a given work box. According to yet another feature of the invention a pot module with liquid reservoir which receives various combinations of color pots is receivable in a work box which also provides space for palettes, brushes and other artist utensils.

BRIEF DESCRIPTION OF THE DRAWINGS

FIGS. 10 and 11 are front and top views, respectively, of an artist's palette box for holding paint pots, palettes, brushes and the like.

Figure 1:
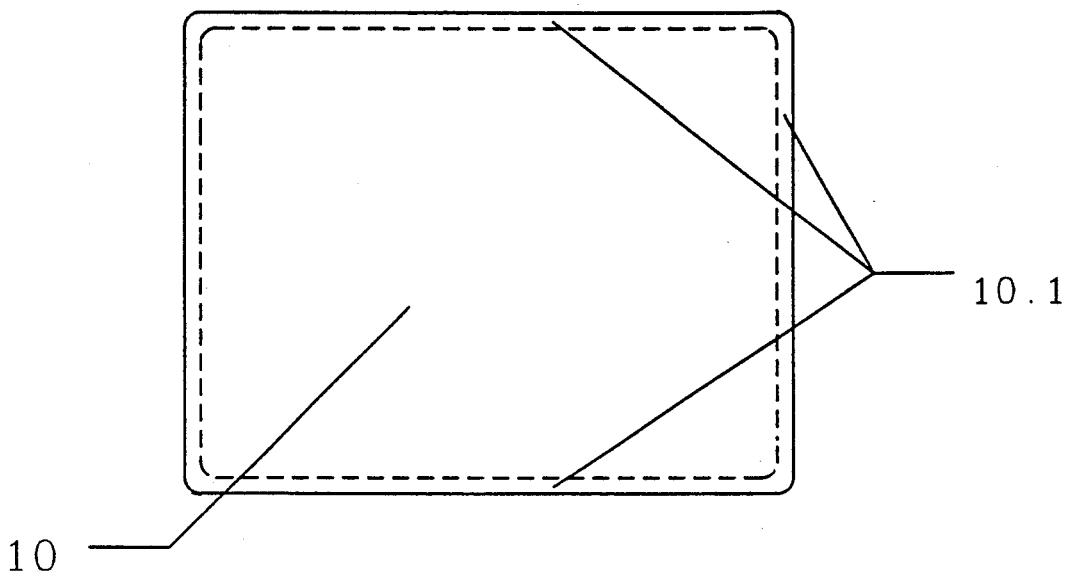
FIGS. 1 and 2 are top and front views, respectively, of a palette made in accordance with the invention.

While the invention is susceptible to various modifications and alternative forms, specific embodiments have been shown by way of example in the drawings and will herein be described in detail. It should be understood, however, that it is not intended to limit the invention to the particular forms disclosed, but on the contrary, the invention is to cover all modifications, equivalents, and alternatives falling within the spirit and scope of the invention as defined by the appended claims.

DESCRIPTION OF PREFERRED EMBODIMENTS

Figure 2:
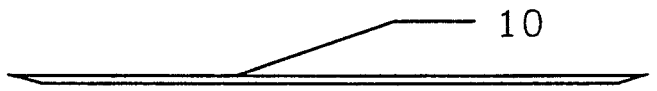

Pigment media suspensions, in particular water color mixtures, have superior wetting, spreading and suspension retention behavior when placed on palette materials having controlled surface roughnesses. Turning now to FIGS. 1 and 2, a palette 10 is made of a material having a surface which is hard and durable, of neutral color such as White, off-white or light gray and which is easily cleanable such as glass, porcelain enamel and other ceramics. Ideally the fluid-pigment-binder suspension will easily spread over the palette surface because of favorable surface energies associated with the suspension and palette surfaces. In accordance with the invention the palette surface is either made or conditioned after making to have a selected roughness characteristic $R_{(e)}$. $R_{(e)}$ used herein is a surface profile measurement and is defined as the height difference between short range maxima and minima surface levels (peak to valley distance) of the palette surface in microinches. $R_{(e)}$ measurements can be determined using surface profile instruments such as Sloan Technologies Dektak 800801 Surface Profilometer. A selected surface roughness of palette surfaces between approximately 5 and 50 microinches provides desirable wetting, spreading and suspension retention behavior of water color suspensions over the palette surface. Such a surface roughness range exhibits little to no staining, puddling or surface contaminant retention.

While a palette surface roughness above 50 microinch also aids in wetting and spreading they become susceptible to fine pigment particle and organic residue attachment to gross surface irregularities. Although some materials have optimum surface properties for wetting and spreading behavior as received from suppliers, such as a fine-grained high alumina ceramic materials with an $R_{(e)}$ surface roughness value of 12 microinch, most desirable palette materials such as porcelain enamel, glass, glazed and imperious ceramics, etc. do not. Typically, as received, such materials have surface roughness $R_{(e)}$ values from less than 1 to 5 microinch.

Smooth palette substrates (less than 5 microinch) can be conditioned by mechanical or chemical means to provide the desired surface roughness. For example, with regard to mechanical preparation, porcelain enamel trays found in butcher shops have been used by some artists to serve as palettes. Constant use of knives, spatulas and washing utensils can abrade the tray surfaces to acceptable surface conditions which allow for acceptable pigment suspension spreading. These surfaces, however, are not uniform in their roughness having various sized grooves formed therein which tends to cause staining and make cleaning difficult. Other suitable mechanical conditioning methods include sandpaper abrasion, abrasive sandblasting and shot peening. However such conditioning methods can damage the porcelain enamel surface in an unpredictable way and spoil other palette attributes.

Chemical conditioning of porcelain enamel surfaces is preferred because it is conducive to a consistent, reproducible surface conditioning. Chemical solutions, treatment temperature and chemical exposure time can all be adjusted and controlled to produce a selected degree of surface roughness in a very uniform and consistent manner.

Porcelain enamel substrates were made in accordance with the invention by coating steel trays with a white enamel finish coating. The as-received porcelain enameled surfaces had an $R_{(e)}$ average value of approximately 2 microinch. As-received porcelain enamel surfaces exhibited some puddling and partial wetting when various water color pigment suspensions were spread and worked onto its untreated surface. The suspension thickness variation caused by puddling or beading impact suspension color intensity perception which is annoying to the artist. Puddles and beads also dry unevenly with occasional cracks occurring in the dried pigment films. Reconstitution of such unevenly dried pigment films are more difficult to achieve compared to uniform films. Pigment films from smooth as-received enamel surfaces are easily cleaned with soft scrubbing and water rinsing.

The trays were then cleaned and were chemically etched with solutions containing dilute hydrofluoric acid. Surface roughness could be increased within the desired $R_{(e)}$ limits when the trays were subjected to 5-30 seconds exposure to dilute hydrofluoric acid-water solutions. Suitable surface conditioning of porcelain enamel surfaces was provided by exposing the surface to 0.5 weight percent HF-water solutions for 5 to 20 seconds. A 0.3/0.7 HF-$HNO_3$ weight percent mixture in water also provided the preferred surface conditioning for similar acid solution exposure times.

The porcelain enamel surfaces conditioned with hydrofluoric acid in accordance with the invention did not exhibit any puddling or dewetting behavior. Pigment suspensions are easily spread over the conditioned surface, are held in place and color mixtures, intensities, etc., are more easily perceived by the artist because of uniformity of liquid film thickness. The spread-out pigments dried evenly into continuous films without binder-particle segregation or cracking and dried films were easily reconstituted without beading or puddling. Enameled surfaces conditioned with hydrofluoric acid could be cleaned as easily as untreated smooth surfaces using soft rubbing and water rinsing. Treated surfaces with $R_{(e)}$ values above 50 microinch became subject to some staining yet were still satisfactorily cleanable for most water color pigment colors. Surface irregularities, porosity and gross defects above the 50 microinch surface roughness character show up as stains and blemishes and are considered undesirable defects.

Glazed ceramic palette surfaces were conditioned with hydrofluoric acid resulting in the desired pigment suspension behavior as observed with the porcelain enamel surfaces. Fine particulate water color pigment suspensions tended to stain glazed ceramic surfaces having $R_{(e)}$ values above 50 microinch, particularly after drying.

Alumina substrate materials can be made to have as-prepared $R_{(e)}$ values within the desired range, such as a fine-grained ceramic (i.e., surface grains of approximately 2 microns) typically used as a substrate for thick-film and thin-film circuitry for the electronics industry. Such material having an $R_{(e)}$ value of 12 microinch was found to be comparable to properly conditioned porcelain enamel or glazed ceramic surfaces and exhibited ideal wetting and suspension spreading behavior for water color palette use.

As noted above metal, polymeric or plastic surfaces typically exhibit hydrophobic behavior when exposed to water-bearing suspensions which tend to bead or puddle up on such surfaces. However, in accordance with the invention such hydrophobic materials can be made suitable for palette use by depositing a tough, continuous hydrophilic material surface onto the polymeric substrate or by attaching an oxide particulate-polymer composite hydrophilic coating onto the polymeric substrate. Suitable substrates may be rigid such as aluminum, steel, acrylic or other plastics or be flexible such as thin films of polyester, acetate or other polymerics. With regard to the deposition approach, it is known in the optical field how to vacuum deposit various oxide coatings on rigid plastics such as eyeglass lenses. These coatings have hydrophilic surface properties as evidenced by water liquid spreading. They are strong, scratch resistant and make suitable water color palettes when deposited on suitable material surfaces with surface roughness $R_{(e)}$ values between 5 and 50 microinch.

With regard to the composite coating approach, a polyester film coated with a fine alumina-polyester, alumina-acrylic and alumina-polyvinyl butyral composite films is known. In accordance with this invention, such oxide particle-polymeric composites are formulated so that the oxide particles have sufficient surface exposed to render the composite surface predominately hydrophilic. The oxide-polymer composite when applied to a rigid or a flexible film substrate by suitable means such as spraying, coating, film casting, calendering, etc. provides a hydrophilic surface to plastic or metal substrate. Water color pigment suspensions easily wet and spread across such composite surface coatings in a manner equivalent to palette surfaces comprised of the glass, porcelain and porcelain enamel materials previously described.

For example, a 3 mil thick polyester film with 0.5 mil composite coating containing 0.3 micron alumina particles embedded in a polyester polymer having a surface roughness $R_{(e)}$ value of 10 microinch was found to exhibit excellent palette surface characteristics for a variety of pigment suspensions made from both "wet" and "dry" water color pigment sources. Suspensions easily wet and spread over the coated surface with no repuddling or beading tendencies. Concentrated and diluted suspensions on this composite film behaved in a manner equivalent to those on optimum conditioned porcelain enamel, porcelain and glass palette surfaces.

Wet pigment suspensions are easily washed from alumina-polyester composite coatings with no apparent staining tendency. The coating has a translucent gray appearance suitable for palette use. Pigment suspensions which dry in place on the film are easily reconstituted to usable pigment suspensions with fresh water added, although minor staining at the edges of the dried suspensions is possible if such suspensions are allowed to fully dry.

Similar suspension wetting behavior was found for 18 mil thick 3 micron sized alumina-polyvinyl butyral composite layers deposited on 7 mil thick polyester film. The thicker alumina-polyvinyl butyral composite showed slightly greater staining tendencies compared to the alumina-polyester composite example. The staining tendency is attributed to open porosity and larger surface pores associated with the lower polymer loading in the composite. Penetration of pigment suspension will occur when dry porous films are loaded with pigmented fluids which is difficult to remove once embedded.

Other oxide particle materials may be used in place of alumina to achieve the desired surface properties and pigment suspension wetting behavior. For example, titania is very acceptable because of its white opaque color, hydrophilic surface properties, availability in micron to sub-micron particle size and ease of fabrication into thin titania-polymer composite films.

The application of deposited or composite layers with selected surface roughness and hydrophilic properties on rigid palettes can be readily accomplished using existing manufacturing methods as employed in the vacuum deposition and plastics coating techniques. Thin composite layers applied to polyester and other film materials can also be accomplished using tape casting, spraying, calendering and printing techniques. Such composite-film laminates are easily cut to a selected size to fit into existing commercially available plastic palette trays or onto suitable palette substrates such as palette 10 of FIGS. 1 and 2. These film palette surfaces are replaceable and can easily be exchanged with other film palette sheets giving the artist greater freedom for painting in the studio or field.

As seen in FIG. 1 palette 10 may be flat but it is preferably provided with a marginal turned up lip 10.1 which extends around the perimeter of the palette to prevent run off of liquid materials. This also serves as an excellent seat for the replaceable film palettes described above.

Figure 3A:
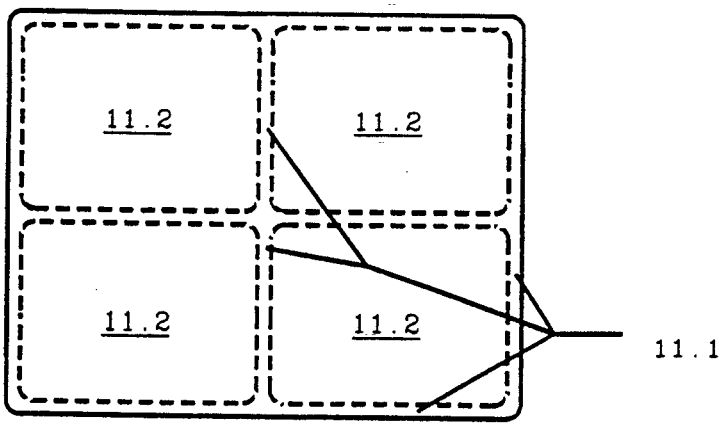
FIGS. 3A & 3B and 4A & 4B are top and front views, respectively, of two modified palettes similar to that of FIGS. 1 and 2.
Figure 4A:
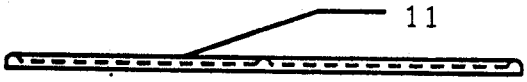
Figure 3B:
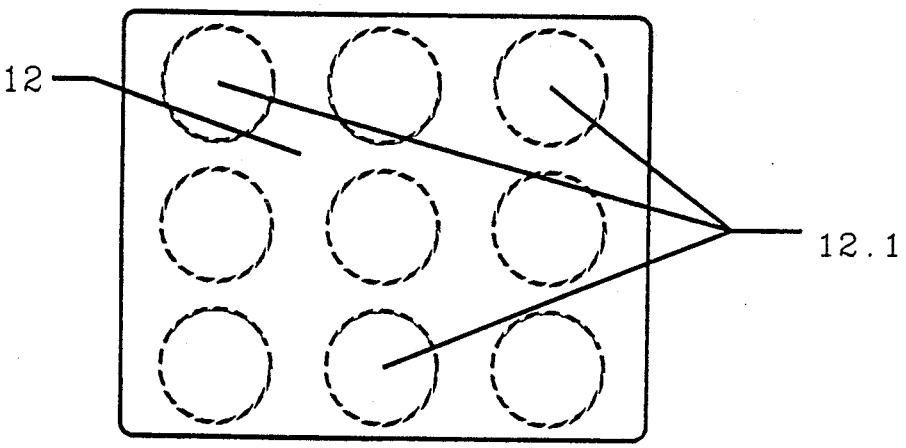
Figure 4B:
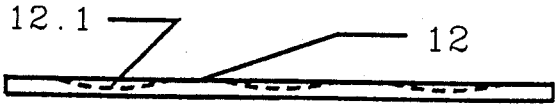

A modified palette is shown in FIGS. 3A and 4A in which a plurality of compartments or mixing sections 11.2 are formed by ribs 11.1 which are also formed around the outer perimeter of the palette 11. This embodiment can be conveniently used to mix different color preparations and keep them isolated from one another. An alternative palette design in shown in FIGS. 3B and 4B in which a plurality of compartments are formed as depressions 12.1 in a flat surface of palette 12 of sufficient volume to separately hold usable quantities of pigment colors. This design is useful particularly for maintenance of multiple pigment suspensions for acrylic and ceramic underglaze/glaze media.

Yet another substrate which serves extremely well as mixing palette as well as temporary storage for pigment suspensions for water-based paint pigments including acrylic, egg tempera, and casein medias is a porous ceramic having a reasonably smooth surface. As discussed above, the pigment suspension medias mentioned have rather limited useful life when worked on conventional impervious mixing palette surfaces, however a dramatic increase in useful life is attained when used on water-saturated porous ceramic surfaces. For example, acrylic and egg tempera can be maintained in the open and remain as reliable pigment suspensions for painting expression for more than eight hours using a water-saturated porous ceramic structure in contradistinction to impervious substrates which provide a useful life in the order of 0.2 to 0.5 hours.

Figure 5:
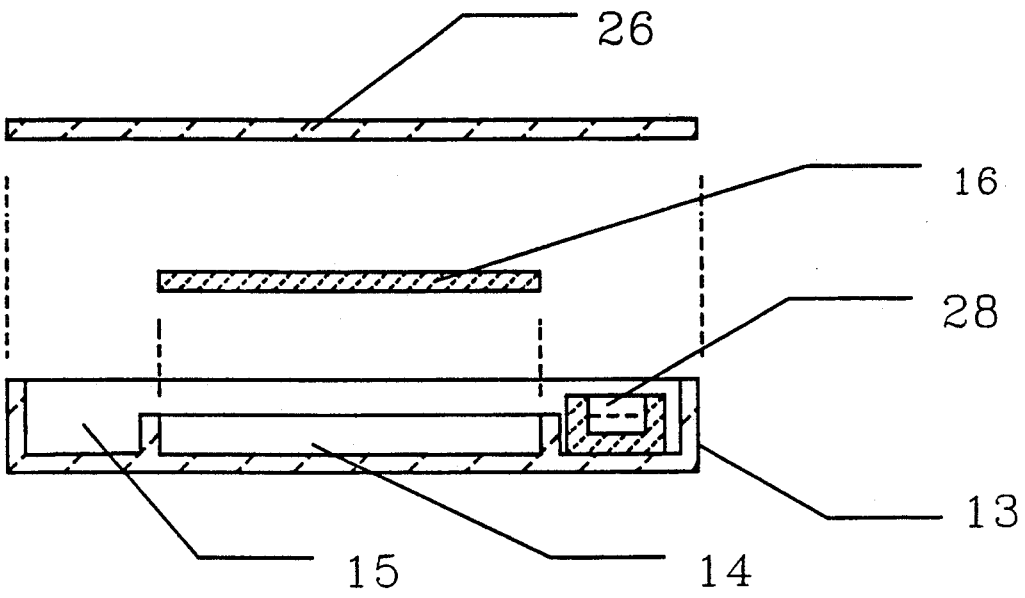
FIG. 5 is a cross sectional view of a paint pot system made in accordance with the invention with a palette and top cover shown separated from a palette seat.

As seen in FIG. 5 a container 13 formed of any suitable impervious material such as plastic or metal is formed with a recess 14 which serves as a palette seat for palette 16 formed of porous ceramic, as described below, and as a fluid reservoir. Other recesses 15 Can be formed in container 13, as desired, for reception of paint pots 28 to be discussed below. In preparation for use, palette 16 is saturated with a compatible fluid as by immersion for sufficient time, e.g. 10 minutes, and then placed in recess 14 which has a supply of the fluid in it. Fluid in recess 14 is then delivered via capillary action through the porous ceramic palette 16 to the bottom surface of the pigment suspension placed on the top surface of the palette. The water-based pigment suspension is relatively thin so that fluid can easily move upwardly between pigment particles to replenish any fluid evaporated from the exposed top surface of the pigment suspension. The rate of fluid permeation through the porous ceramic can be controlled by system parameters, in particular open pore channels and pore volume, container and palette dimensions and hydrostatic head between the reservoir and the pigment suspensions. Porous ceramic structures can advantageously be tailored so that permeation behavior can match evaporation conditions normally encountered in art studio or other painting environments and thereby maintaining pigment suspensions at or near optimum paint application conditions.

Even though pigment suspension mixtures contain pigment particles that can be sub-micron in size, pore channel blocking which would interrupt fluid delivery, does not appear to create a problem with commercial pigment formulations normally used by artists. Substrates having high porosity levels and/or surface roughness greater than 50 microinch tend to experience some staining characteristics; however the tendency is greatly reduced if the prepared surface has a roughness $R_{(e)}$ value between 5 and 50 microinch. Although recess 14 in container 13 provides excellent fluid delivery to palette 16 it Will be understood that other reservoir defining means can be employed with varying degrees of effectiveness. For example, a porous palette which has been saturated with fluid can be placed on an adsorbent material such as wet paper towels which will serve as a fluid reservoir for a limited time.

It is convenient to place a cover 26 over the container 12 shown in FIG. 5 to maintain paint pigments on porous palette surfaces for storage after painting sessions such as overnight or over weekends. A tight fitting cover will establish a high humidity environment within the storage cavity and prevent the suspension from drying beyond useful properties such as acrylic emulsion breakdown. The artist needs only to maintain fluid in the reservoir recess 14 at a desired level to assure delivery via capillary action.

Figure 6:
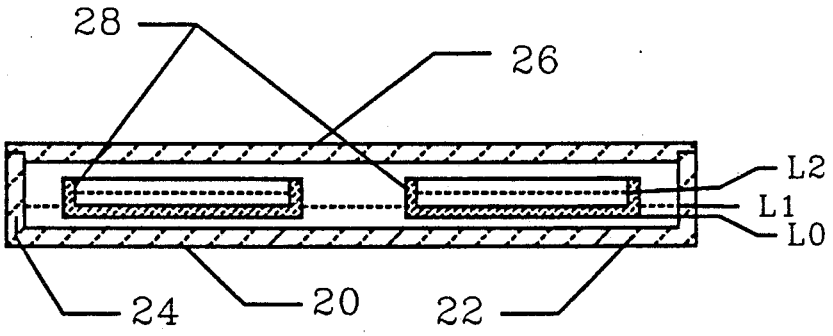
FIG. 6 is a cross sectional view of another embodiment of a paint pot system made in accordance with the invention.
Figure 7:
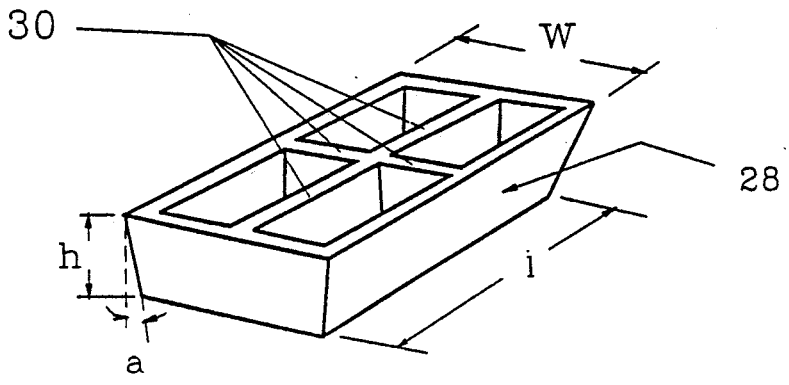
FIG. 7 is a perspective view of a paint pot made in accordance with the invention.

With particular respect to FIGS. 6 and 7, porous ceramic bodies 28 are shown and used as paint pots. As mentioned above, an artist may place many compatible wet pigment colors into such pots for ease and convenience rather than continually extracting them from tubes . The artist can more easily take desired pigments from these pots conveniently arranged near his working palette and apply them to provide his artistic expression. When taking wet pigments from pots, it is desirable that all the compatible pigments have textures and characteristics which are consistent and manageable. The maintenance of these pigment handling characteristics while in the pots is important to the artist.

Figure 8:
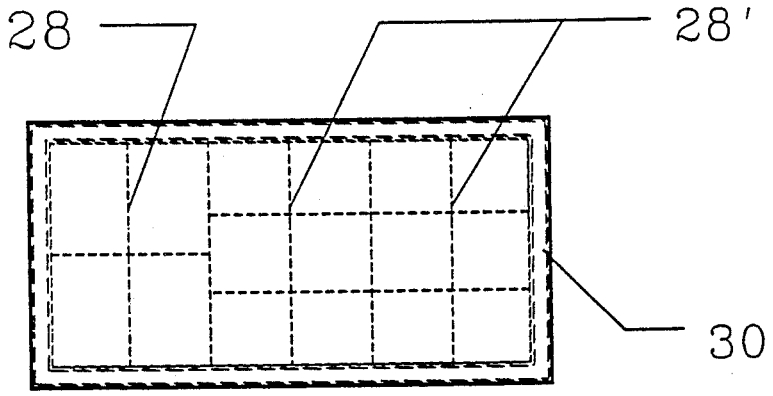
FIGS. 8 and 9 are top and front views, respectively, of a paint pot module useful in the FIGS. 10 and 11 artist's palette box.
Figure 9:
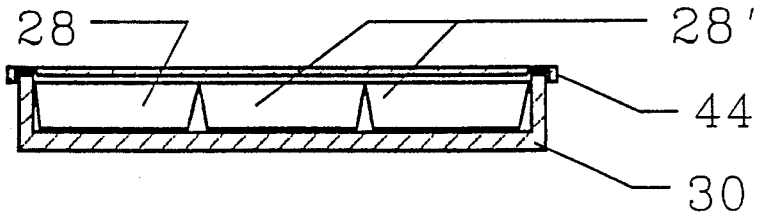

The paint module systems as shown in FIGS. 6, 8 and 9 allow pigments contained therein to be maintained at the desired working consistency over wide painting and storage environments. An open ended container 20 is formed of a suitable impervious material, such as plastic or metal, and has a bottom wall 22 and upstanding side walls 24. A tight cover 26 is receivable over the open end of the container. One or more paint pots 28 formed of porous material, such as porous ceramic, are disposed in container 20 leaving sufficient space between the paint pots and the container walls to form a fluid reservoir. The paint pots may comprise a single cavity as shown in FIG. 6 or may have dividing walls 30 as shown in FIG. 7 to provide a selected number of cavities.

Saturated porous pots 28 shown in FIG. 6 having a wet pigment suspension filled to level $L_2$ are placed in container 20 having a fluid reservoir with fluid at level $L_1$. The porous nature of the ceramic will allow fluid to flow from the reservoir through the porous ceramic to the paint pot interior. Hydrostatic head differences, capillary forces, the size and volume of the open pore channels and fluid concentration differences between reservoir and pigment are factors which affect the delivery of fluid to the pigment suspension. As will be described below the ceramic porosity is selected to deliver fluid to pigment suspension in the pot at a rate at least equivalent to normal evaporation conditions experienced during an artist's paint session. Once the painting session is over the paint pot reservoir system is prepared for storage and covered by cover 26. Fluid evaporation from the pigment suspension will cease and flow through the porous ceramic is substantially reduced.

Figure 10:
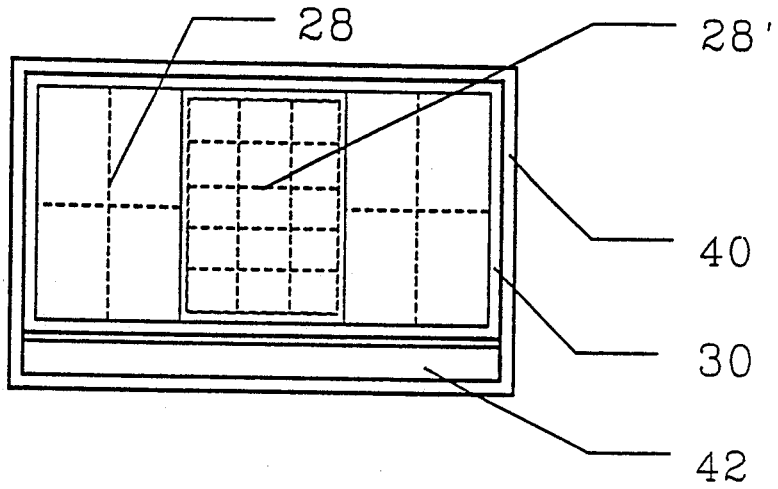
Figure 11:
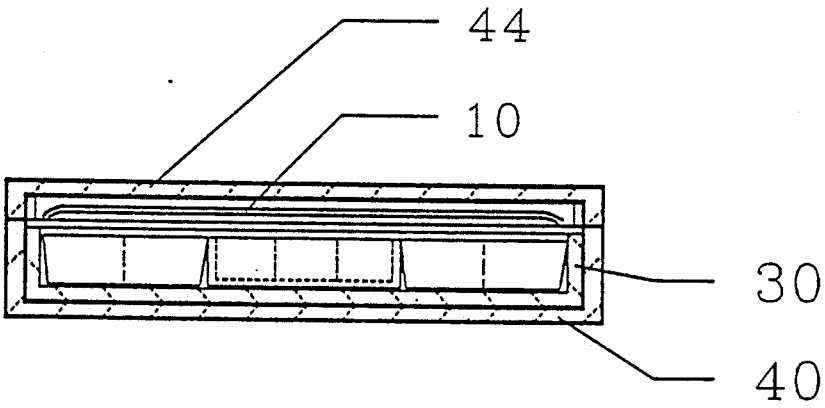

The particular dimensions of the pots and container are matters of choice however it is preferred that the length and width dimensions of the pots be integer multiples of one another and the paint pot reservoir an integer multiple of the pot units to provide optimum flexibility in answering an artist's need for a selected objective. That is, for a given art endeavor, the volume of certain colors may require a larger or smaller number paint pot cavities than others. Thus as seen in FIGS. 8 and 9, different size paint pots 28 and 28', are adapted to fit into a module 30 utilizing the entire space defined by the module. The module is formed of impervious material to serve as a fluid reservoir container and it in turn is receivable in a field workbox 40 as shown in FIGS. 10 and 11. Work box 40 receives module 30, a suitable paintbrush holder 42 and one or more palettes 10 and is closed by a suitable cover 44.

One acceptable paint pot wall dimension design is as follows:

| | |
|---|---|
| Side Wall Thickness | ~⅛" ± |
| Bottom Wall Thickness | ~⅛ to 3/16" |
| Containment Height | ~½ to 5/16" |
| Open Porosity | 6 to 38 v/o pores |

As shown in FIG. 7 the side walls are preferably slightly inclined outwardly a to facilitate delivery of water to all four side walls of the paint pot. If desired, small protrusions may be provided in the bottom wall of the reservoir container to insure that the fluid can get to the entire bottom surface of the paint pot. The reservoir container is selected to be large enough to contain enough fluid for selected storage periods of time, for example one or two weeks. The paint pot design cited will easily accommodate hydrostatic head adjustment between 0.01 and 0.2 inches depending upon the permeation rate and environmental conditions required.

By way of example, one such paint pot made in accordance with the invention was formed from mullite-clay raw materials and matured at high temperature. The pot had a wall thickness of approximately 0.165 inch, a sintered density of 2.02 g/cc and percent open porosity of approximately 18.4 v/o.

A variety of water-based pigments were placed in such paint pots contained in a reservoir container system similar to that shown in FIG. 6. The pigment suspensions were monitored periodically to determine painting quality and storage life time interval. Acrylic and water color paints were maintained for more than 2 months, ceramic glaze/underglazes for more than 3 weeks, and egg tempera mixtures for more than 4 days without suspension quality deterioration.

Figure 12:
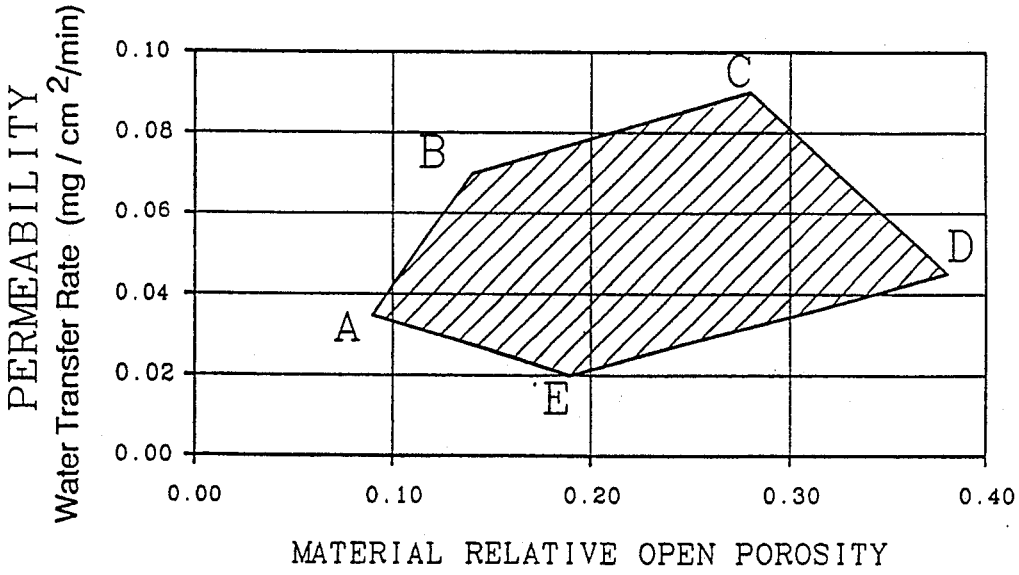
FIG. 12 is a graph of permeation rate vs. relative open porosity showing boundaries for acceptable bodies useful with the invention.

Acceptable porous materials for the pigment containment and mixing palettes can be found in an area bounded by connection of points A, B, C, D, and E as shown in FIG. 12, permeability-open porosity diagram. The permeability-porosity area boundary for water delivery was determined using commercially available porous ceramic materials including mullite-clay, talc and a variety of high alumina bodies and the water-based pigment suspensions mentioned earlier. The A-B-C boundary focuses on materials and microstructural features which define the upper flow rate limit for containment/mixing palette use. Point A establishes a minimum open porosity-permeability rate necessary to provide fluid to pigment suspensions for coarse textured porous ceramic bodies. As one progresses along the A-B-C line, a progressive change from coarse textured, open pore structure to a more uniform, finer textured pore structure is evidenced. The relative strength of the ceramic structures along this boundary are roughly equivalent to one another and found to be acceptable. The C-D boundary focuses on the shift from upper to lower permeation rate limit as well as continued microstructural shift towards finer textured ceramics. Porous structures at higher open porosity levels can be used as one progresses along line C-D but water transfer rate diminishes because of the long, torturous nature of the fine textured open pore structure. A maximum open porosity limit at D establishes the microstructural limit of fine textured porous bodies. The D-E-A boundary line focuses on microstructural features which define the lower flow rate limit for containment and mixing palette use. A progressive microstructural change from fine to coarse textured porous structures occurs as one progresses along the path D-E-A. The relative strengths of the porous bodies along this path are equivalent to one another but are stronger compared to bodies of equivalent porosity along the upper permeability limit line A-B-C.

The boundary limits shown in FIG. 12 are based on conventionally processed porous oxide ceramic bodies known to be commercially available and for water-based pigment media suspensions. These limits could change if pertinent ceramic properties, raw materials and processing techniques (strength, surface energy, microstructure, etc.) are manipulated or changed.

The boundary limits shown in FIG. 12 are also suitable for other pigment-fluid systems such as pigment-evaporatable organic fluid suspensions typically used in the printing industry. Both high and low evaporation rate organic fluid-pigment suspensions on suitable porous material surfaces are maintained for periods at least four times as long as suspensions placed on impervious surfaces and subjected to the same drying environmental conditions.

Porous materials other than ceramic can be used to deliver fluids and maintain a variety of fluid-pigment suspensions. For such a pigment media maintenance system to operate, a positive driving force to assure fluid flow and delivery from the reservoir to the pigment suspension is needed. Such driving forces include, wetting, capillary action, pressure differential, fluid concentration differential, etc. Wetting and capillary action appear to be the more influential forces operating on the devised pigment maintenance system of this invention.

The principles demonstrated with artist's water-based pigment medias and porous ceramic materials such as mullite-clay, talc and high alumina ceramics can be applied to other fluid-pigment suspensions such as volatile organic solvent-based pigment suspensions and to other porous materials classes such as metals, polymers and composites. In addition to the delivery capacity of the porous substrate the same consideration of surface roughness $R_{(e)}$ values discussed above would apply to these other porous substrates. That is, at a surface roughness of greater than 50 microinch the surface becomes susceptible to staining.

Thus in accordance with the invention a system has been described which enables the maintenance of fluid suspension within a desired fluid-pigment-binder proportion range dependent upon fluid composition and mixture properties. The porous materials described allow for movement of the fluid component from the outside reservoir through a membrane or wall to the inner wall surface containing the suspension mixture. For fluid movement to occur a thermodynamic driving force is utilized as by wetting of the container surfaces by the reservoir fluid and suspension mixture. If the fluid and suspension are compatible with one another the permeation of the fluid through the membrane will be determined by the membrane structure and fluid and suspension properties and fluid flow principles governed from permeation theory.

However, in accordance with the invention, it is sometimes desirable to isolate the suspension mixture in a color pot and maintain its properties within a desired performance range by avoiding fluid loss through the porous walls. This can be achieved by using a reservoir fluid which is incompatible with the mixture. For example water can be used in the reservoir and oil-based paints can be contained in the color pots. The ceramic oxide surfaces have hydrophilic properties and water is preferred over organic fluids while in contact with the ceramic surface. This water reservoir-porous ceramic-oil-based pigment system can be used to store such pigments indefinitely so long as the water barrier in the open pore insterstices is maintained. The water barrier coupled with an air-tight cover to seal the container creates a positive solvent vapor pressure to provide indefinite storage without oil-base liquid loss.

We claim:

1. A pigment maintenance system comprising
   a. an open ended impervious container having a bottom wall and upstanding side walls defining a cavity therein,
   b. at least one pot having a bottom wall and upstanding side walls having dimensions selected to fit within that cavity, the pot composed of a substrate formed solely of porous material and a coating deposited on the substrate, the combined coating and substrate having water permeability versus relative open porosity within the pentagonal area defined by points A, approximately 0.035 permeability, 0.09 open porosity; B, approximately 0.07 permeability, 0.14 open porosity; C, approximately 0.09 permeability, 0.28 open porosity; D, approximately 0.045 permeability, 0.38 open porosity; E, approximately 0.02 permeability, 0.19 open porosity of FIG. 12, the material having a network of interconnecting pores communicating therewith whereby fluid placed in the cavity between the container and the pot will be able to flow through the walls of the pot into a wet pigment suspension within the pot to replenish any fluid driven from the pigment suspension by environmental exposure.

2. A pigment maintenance system according to claim 1 in which a plurality of pots are received within the cavity.

3. A pigment maintenance system according to claim 2 further including a cover received on the side walls of the container to seal the container.

4. A paint pot system according to claim 1 in which the open porosity of the pots is approximately 18.4 volume percent.

5. A paint pot system according to claim 1 in which the open porosity results in permeation of fluid at approximately 0.051 mg/cm$^2$/min with a 0.01 to 0.15 inch reservoir height about the bottom wall of the pot, the walls of the pot being $\frac{1}{8}$ inch thick and the pot height being approximately $\frac{5}{8}$ inch high.

6. A pigment maintenance system comprising
   a. liquid solvent reservoir defining means including side walls and a cover received on the side walls if desired, and
   b. a generally flat plate having a top surface and having dimensions selected to fit within the reservoir defining means formed solely of a substrate of porous material and a coating deposited on the substrate, the combined coating and substrate having water permeability versus relative open porosity within the pentagonal area defined by points A, approximately 0.035 permeability, 0.09 open porosity; B, approximately 0.07 permeability, 0.14 open porosity; C, approximately 0.09 permeability, 0.28 open porosity; D, approximately 0.045 permeability, 0.38 open porosity; E, approximately 0.02 permeability, 0.19 open porosity of FIG. 12, the material having a network of interconnecting pores communicating therethrough whereby liquid solvent placed in the cavity will be able to flow through the plate into the solvent pigment suspension on the top surface of the plate to replenish any fluid driven from the pigment suspension by environmental exposure.

7. A pigment maintenance system according to claim 6 in which the flat plate has a desired number of depressions capable of holding a suitable quantity of fluid-pigment suspensions for artist painting sessions.

8. An artist's palette comprising a generally flat plate having a plurality of compartments and being formed of a substrate formed solely of porous material and a coating deposited on the substrate, the combined coating and substrate having water permeability versus relative open porosity within the pentagonal area defined by points A, approximately 0.035 permeability, 0.09 open porosity; B, approximately 0.07 permeability, 0.14 open porosity; C, approximately 0.09 permeability, 0.28 open porosity; D, approximately 0.045 permeability, 0.38 open porosity; E, approximately 0.02 permeability, 0.19 open porosity of FIG. 12, the material having a surface roughness R(e) value approximately 5–50 microinch.

9. An artist's palette according to claim 8 in which an upstanding lip is formed about the perimeter of the plate, the lip having a height just sufficient to prevent run-off of liquids placed on the palette.

10. An artist's palette comprising a generally thin, essentially entirely flat plate solely of a substrate of porous material and a coating deposited on the substrate, the combined coating and substrate having water permeability versus relative open porosity within the pentagonal area defined by points A, approximately 0.035 permeability, 0.09 open porosity; B, approximately 0.07 permeability, 0.14 open porosity; C, approximately 0.09 permeability, 0.28 open porosity; D, approximately 0.045 permeability, 0.38 open porosity; E, approximately 0.02 permeability, 0.19 open porosity of FIG. 12.

11. An artist's palette according to claim 10 in which the surface of the palette has a surface roughness between approximately 5–50 microinch.

12. An artist's palette according to claim 9 in which the material is chosen from a group consisting of glass, porcelain enamel and ceramic.

13. A pigment maintenance system according to claim 1 in which the material for the pots is selected from a group consisting of mullite-clay or other suitable ceramic.

14. A pigment maintenance system comprising a module formed of impervious material having a bottom wall and upstanding side walls and having a length and width, and a plurality of paint pots formed solely of a porous ceramic substrate and a coating deposited on the substrate, the combined coating and substrate having water permeability versus relative open porosity within the pentagonal area defined by points A, approximately 0.035 permeability, 0.09 open porosity; B, approximately 0.07 permeability, 0.14 open porosity; C, approximately 0.09 permeability, 0.28 open porosity; D, approximately 0.045 permeability, 0.38 open porosity; E, approximately 0.02 permeability, 0.19 open porosity of FIG. 12, the pots having a bottom wall and upstanding side walls and having a length and width that are respectively evenly divisible into the length and width of the module being received on the bottom wall of the module.

15. A pigment maintenance system according to claim 14 in which at least some of the paint pots have different widths.

16. A pigment maintenance system according to claim 14 in which at least some of the paint pots have different lengths.

17. A pigment maintenance system according to claim 14 including a work box having a storage cavity therein, the module receivable in the storage cavity.

* * * * *